US005527413A

United States Patent [19]

Perry et al.

[11] Patent Number: 5,527,413

[45] Date of Patent: Jun. 18, 1996

[54] TEMPERATURE CONTROLLED SUSCEPTOR STRUCTURE

[75] Inventors: Michael R. Perry, Plymouth; Ronald R. Lentz, Wayzata, all of Minn.

[73] Assignee: The Pillsbury Company, Minneapolis, Minn.

[21] Appl. No.: 146,218

[22] Filed: Nov. 1, 1993

Related U.S. Application Data

[62] Division of Ser. No. 630,867, Dec. 20, 1990, abandoned.

[51] Int. Cl.[6] ..... B32B 31/00

[52] U.S. Cl. ..... 156/229; 219/678; 219/725; 219/730; 426/107; 383/116

[58] Field of Search ..... 219/10.55 E, 678, 219/725, 730; 383/116; 156/229; 426/107

[56] References Cited

U.S. PATENT DOCUMENTS

| | | | |
|---|---|---|---|
| 3,982,863 | 9/1976 | Latham et al. | 264/22 |
| 4,332,276 | 3/1982 | Meckel et al. . | |
| 4,391,833 | 7/1983 | Self et al. | 426/523 |
| 4,426,275 | 1/1984 | Meckel et al. . | |
| 4,641,004 | 2/1987 | Seiferth . | |
| 4,641,005 | 2/1987 | Seiferth | 219/10.55 E |
| 4,666,263 | 5/1987 | Petcavich . | |
| 4,713,510 | 12/1987 | Quick et al. . | |
| 4,735,513 | 4/1988 | Watkins et al. | 383/116 |
| 4,740,377 | 4/1988 | Dawes et al. | 426/234 |
| 4,911,938 | 3/1990 | Fisher et al. . | |
| 4,916,279 | 4/1990 | Brown et al. . | |
| 4,933,526 | 6/1990 | Fisher et al. . | |
| 4,940,867 | 7/1990 | Peleg . | |
| 5,124,388 | 6/1992 | Pruett et al. | 524/343 |
| 5,126,519 | 6/1992 | Peleg | 219/10.55 E |

FOREIGN PATENT DOCUMENTS

| | | |
|---|---|---|
| 0312333 | 10/1988 | European Pat. Off. . |
| 0320293 | 12/1988 | European Pat. Off. . |
| 0320294 | 12/1988 | European Pat. Off. . |
| 0335478 | 1/1989 | European Pat. Off. . |
| 0334389 | 5/1989 | European Pat. Off. . |
| 0343006 | 5/1989 | European Pat. Off. . |
| 0397597 | 4/1990 | European Pat. Off. . |
| WO89/11771 | 11/1989 | WIPO . |

OTHER PUBLICATIONS

*Microwave Packaging Symposium*, Sponsored by Rutgers University Center for Packaging Science & Engineering and American Management Association, Apr. 23–24, 1990.

*Plastics Which Extend The Performance Of Microwave Packaging*, F. E. McFarlane and C. M. Strip, Eastman Chemical Company, Kingsport, Tennessee, Apr. 1990.

*Application Of A Teflon Single–Sided Migration Cell For Measuring Migration Through Microwave Susceptor Films*, a group of overheads from a program by Timothy H. Begley and Henry C. Hollifield, Nov. 1990.

*Microwave Packaging Symposium*, Sponsored by Rutgers University Center for Packaging Science & Engineering, and American Management Association, Apr. 23–24 1990.

"Plastics which Extend the Performance of Microwave Packaging, " F. E. McFarlane et al, Eastman Chemical Company, Kingsport, Tennessee, Apr. 1990/.

"Application of a Teflon Single–Sided Migration Cell for Measuring Migration Through Microwave Susceptor Films, " A group of overhead slides from a program by T. H. Begley and H. C. Hollifield.

*Primary Examiner*—Chester T. Barry

*Attorney, Agent, or Firm*—Westman, Champlin & Kelly

[57] ABSTRACT

A susceptor according to the present invention includes a substrate having physical properties so that melting and size deformation of the substrate occur in response to microwave absorption by the susceptor. A metalized layer is coupled to the substrate, and supporting means is provided for supporting the substrate and the metalized layer.

6 Claims, 3 Drawing Sheets

TEMPERATURE CONTROLLED SUSCEPTOR STRUCTURE

This is a divisional of application Ser. No. 07/630,867, filed Dec. 20, 1990, now abandoned.

INCORPORATION BY REFERENCE

The following patent application is hereby fully incorporated by reference: a patent application entitled A TWO-SIDED SUSCEPTOR STRUCTURE, by Michael R. Perry, Ser. No. 07/631,285 filed on Dec. 20, 1990 now U.S. Pat. No. 5,170,025 and assigned to the same assignee as the present application.

BACKGROUND OF THE INVENTION

The present invention involves microwave cooking. More particularly, the present invention is a susceptor structure for use in a microwave oven.

Heating of foods in a microwave oven differs significantly from heating of foods in a conventional oven. In a conventional oven, heat energy is applied to the exterior surface of the food and moves inward until the food is cooked. Thus, food cooked conventionally is typically hot on the outer surfaces and warm in the center.

Microwave cooking, on the other hand, involves absorption of microwaves which characteristically penetrate far deeper into the food than does infra red radiation (heat). Also, in microwave cooking, the air temperature in a microwave oven may be relatively low. Therefore, it is not uncommon for food cooked in a microwave oven to be cool on the surfaces and much hotter in the center.

However, in order to make the exterior surfaces of food brown and crisp, the exterior surfaces of the food must be heated to a sufficient degree such that moisture on the exterior surfaces of the food is driven away. Since the exterior surfaces of the food cooked in a microwave oven are typically cooler than the interior of the food, it is difficult to brown food and make it crisp in a microwave oven.

In order to facilitate browning and crisping of food in a microwave oven, devices known as susceptors have been developed. Susceptors are devices which, when exposed to microwave energy, become very hot. By placing a susceptor next to a food product in a microwave oven, the surface of the food product exposed to the susceptor is surface-heated by the susceptor. Thus, moisture on the surface of the food is driven away from the surface of the food and the food becomes crisp and brown.

Many conventional susceptor structures have included a thin metal film, typically aluminum, deposited on a substrate such as polyester. The metalized layer of polyester is typically bonded, for support, to a support member such as a sheet of paperboard or corrugated paper.

Conventional susceptors, however, have certain drawbacks. They undergo a process referred to herein as breakup in which the electrical continuity of the thin metal film is lost during cooking. The result of the loss of electrical continuity is an irreversible loss in the susceptor's microwave responsiveness and a lower level of percent power absorption by the susceptor during cooking. Lower power absorption leads to lower susceptor cooking temperatures and a corresponding decrease in the susceptor's ability to crisp food.

The susceptor's ability to crisp food is particularly hampered when the susceptor undergoes breakup prior to reaching a temperature which is sufficient to drive moisture from the surface of the food. The substrates of typical prior art susceptor structures were formed of Polyethylene Terephthalate (PET). The metalized layer was typically aluminum deposited on the PET layer. These susceptors typically underwent breakup at approximately 200° C. In many cases, this is inadequate to properly surface heat food to achieve desired crisping and browning.

Thus, other materials have been tried as the substrate in susceptor structures. For example, Polyetherimide (PEI) has been metalized and used as a susceptor. When these susceptors are coupled to a support member such as cardboard, the paperboard scorches and chars because the susceptor undergoes breakup at an elevated temperature.

The foregoing discussion shows that susceptors are functional because of two seemingly similar but different principles. Susceptors heat because they absorb microwave energy which is converted to heat energy. The amount of microwave energy absorbed by susceptors depends on the surface impedance of the susceptor.

In addition to heating through absorption of microwave energy, susceptors must possess a temperature limiting feature to prevent the susceptor from over heating and scorching paper, food or other things in contact with the susceptor.

For these reasons, there is a continuing need for the development of a susceptor structure which is capable of reaching and maintaining cooking temperatures suitable for crisping and browning food products, but which also has a temperature control mechanism to avoid runaway heating conditions.

SUMMARY OF THE INVENTION

A susceptor according to the present invention includes a substrate having physical properties so that melting and size deformation of the substrate occur in response to microwave absorption by the susceptor. A metalized layer is coupled to the substrate, and supporting means is provided for supporting the substrate and the metalized layer.

DETAILED DESCRIPTION OF THE PREFERRED EMBODIMENTS

Figure 1A:
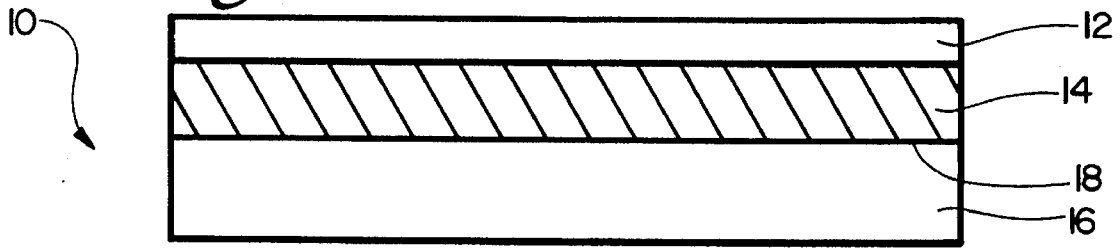
FIG. 1A is a side view of a susceptor structure of the present invention.

FIG. 1A shows the relative position of components of a susceptor structure 10 (susceptor 10). It should be noted that susceptor 10 is not drawn to scale in FIG. 1A. For clarity's sake, the thicknesses of layers shown in FIG. 1A are greatly exaggerated.

Susceptor 10 includes substrate 12 upon which metalized layer 14 is deposited. Susceptor 10 also includes a support layer 16. Substrate 12 is typically a thin layer of oriented and heatset polymer material such as polyethylene terephthalate (PET). Metalized film 14 is typically an aluminum layer deposited on substrate 12 through vacuum evaporation, sputtering, or another suitable method. Support layer 16, typically paperboard or corrugated paper, is coupled to metalized layer 14 at interface 18 through the use of an adhesive.

Figure 1B:
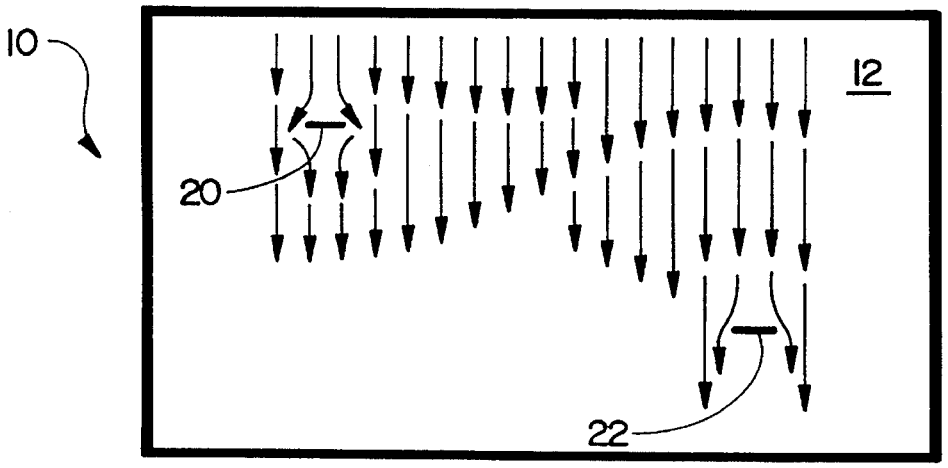
FIG. 1B is a top view of the susceptor structure shown in FIG. 1A and showing the development of hot spots.

When susceptor 10 is placed in a microwave oven and exposed to microwave energy, current begins to flow in metalized layer 14 of susceptor 10 due to an electric field generated by the microwave oven. A portion of the current flowing in metalized layer 14 is indicated by the vertical arrows shown in FIG. 1B. As current flows, metalized layer 14 begins to heat as a function of the current generated and the surface impedance ($Z_s$) of layer 14. However, it has been observed that metalized layer 14 does not heat uniformly. Rather, hot spots, such as spots 20 and 22, develop as illustrated in FIG. 1B.

As metalized layer 14 continues to heat, and as hot spots 20 and 22 grow hotter, heat transfers throughout the susceptor 10, and the temperature of substrate 12 also increases. Discontinuities such as thinned areas, holes, or cracks are formed in metalized layer 14 at the hot spots 20 and 22.

Figure 1C:
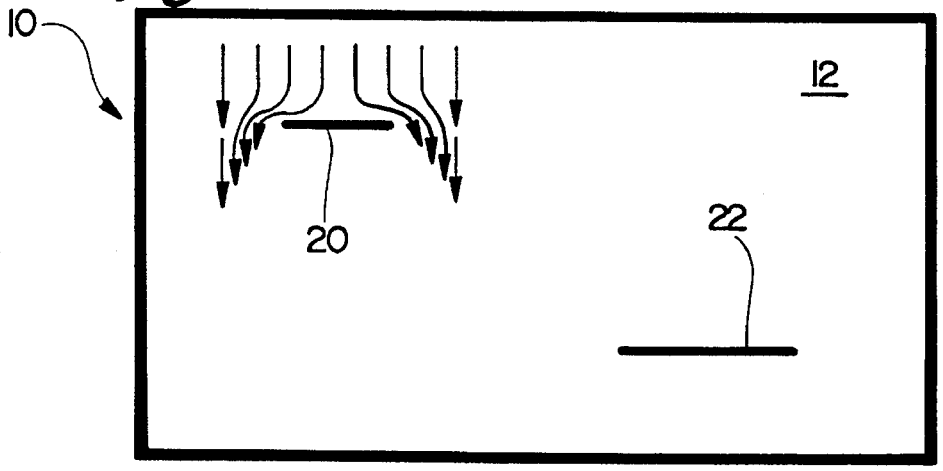
FIG. 1C is a top view of the susceptor structure shown in FIGS. 1A and 1B after discontinuities at the hot spots have expanded laterally.

FIG. 1C shows a top view of susceptor 10 with the discontinuities at hot spots 20 and 22 having expanded into lateral cracks or thinned areas. As the temperature of susceptor 10 continues to rise, more spots on susceptor 10 approach the temperature where additional lateral cracks form in substrate 12, thereby driving the formation of more discontinuities in metalized layer 14. The lateral cracks and discontinuities which form in substrate 12 and metalized layer 14 substantially destroy the electrical continuity in metalized layer 14. This decreases the responsiveness of susceptor 10 to microwave energy, and susceptor 10 begins to cool despite continued exposure to microwave energy. Thus, the ability of susceptor 10 to provide further heating is essentially destroyed.

It should be noted that the electric field in a microwave oven has random direction. Thus, discontinuities generally form in many directions on metalized layer 14 and follow hot spot locations.

In addition, it should be noted that PET substrate 12 generally begins to drive the formation of discontinuities when the temperature at hot spots 20 and 22 is at approximately 250° C. However, the majority of the surface of susceptor 10, other than hot spots 20 and 22, is typically much cooler (e.g. 200° C. or even cooler). Thus, the majority of the surface area of susceptor 10 may only attain a temperature range of 200° C.–220°C. before it breaks up and losses some of its ability to absorb microwave energy. The resulting capability of susceptor 10 to absorb microwave energy is insufficient to properly surface heat food to attain desired browning and crisping.

Figure 2:
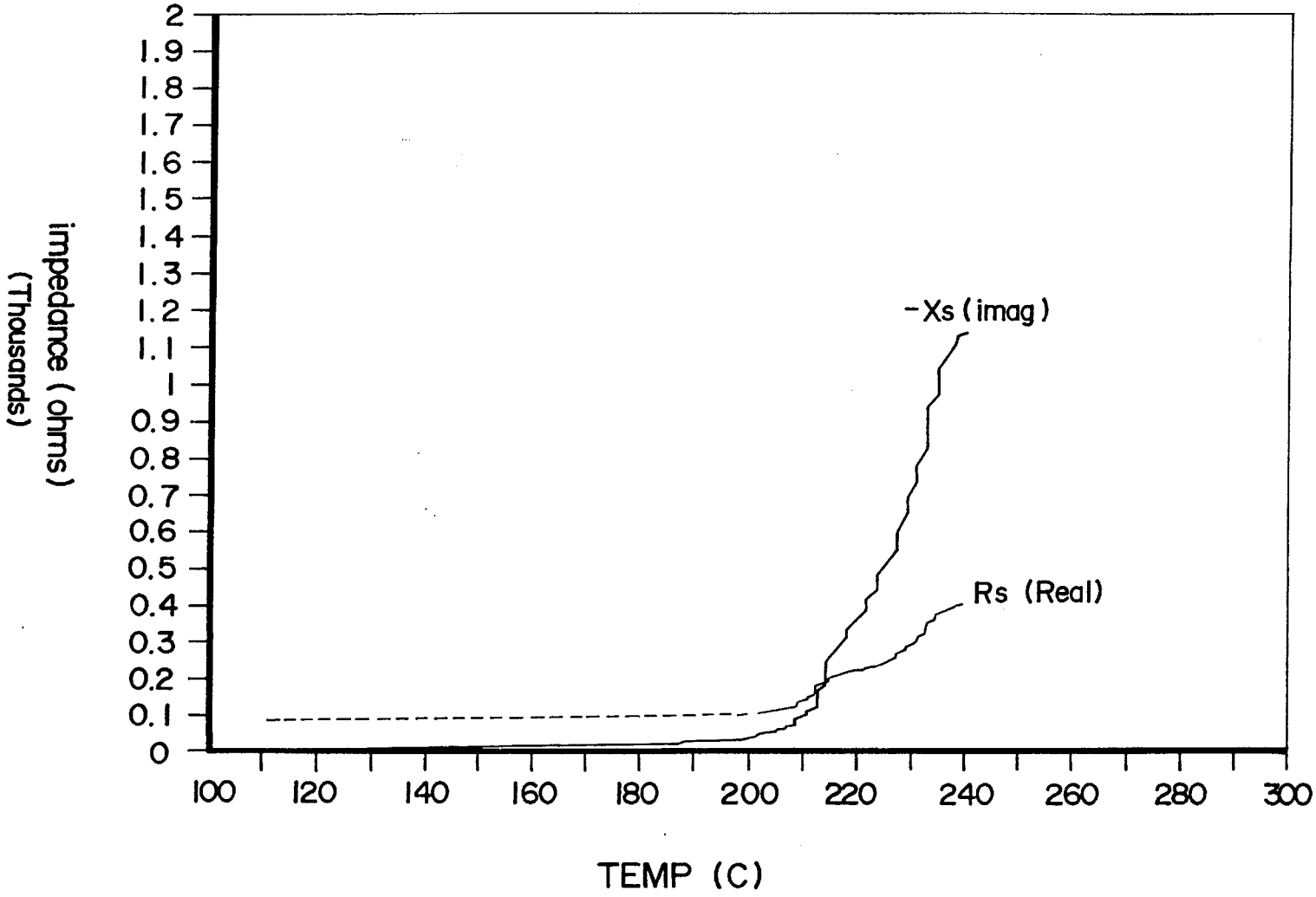
FIG. 2 shows a graph of impedance (real and imaginary) plotted against temperature and degrees Celsius for a typical susceptor structure.

FIG. 2 shows a graph of impedance (real, $R_s$, and imaginary, $X_s$) of metalized layer 14 in a conventional PET susceptor structure plotted against temperature in degrees C. The susceptor structure was exposed to microwave energy in a test fixture and, as it heated, the impedance of the metalized layer 14 changed. FIG. 2 shows that at approximately 200° C. to 210° C., the impedance rose sharply. This is due to the formation of numerous cracks or discontinuities in the metalized layer 14 of the susceptor. The sharp increase in impedance resulted in less current flowing in metalized layer 14 of the PET susceptor structure and a corresponding decrease in heating of the susceptor structure.

Figure 3:
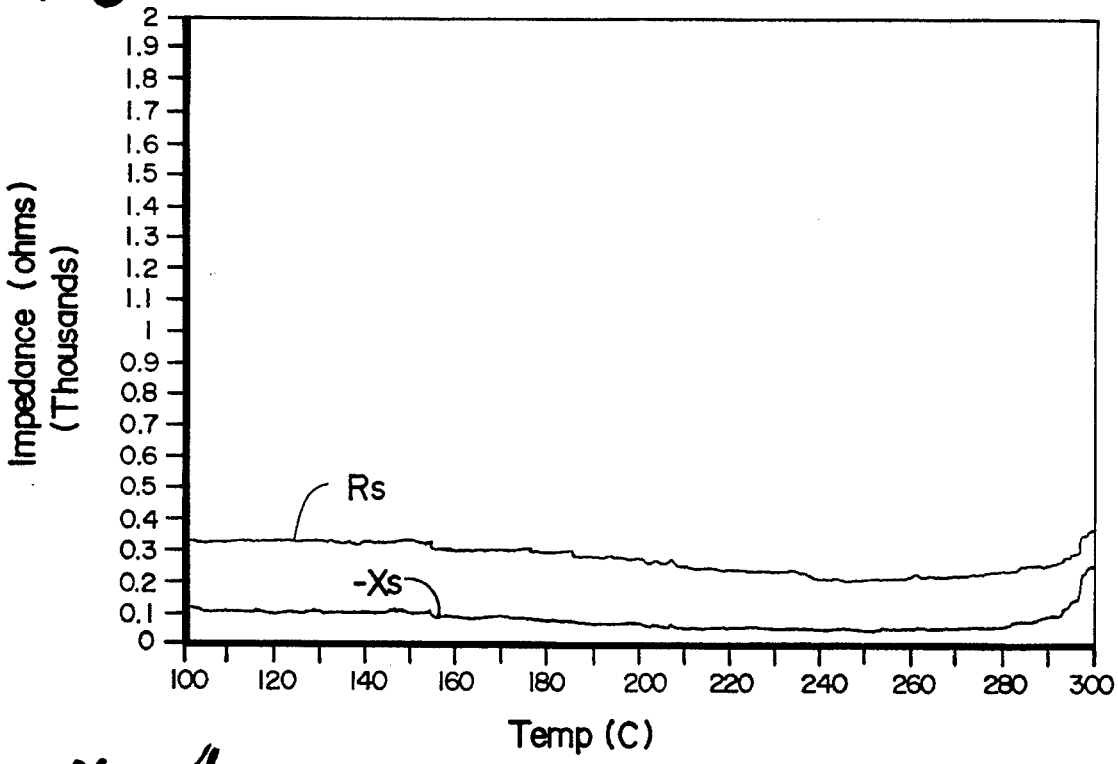
FIG. 3 shows a plot of impedance (real and imaginary) plotted against temperature and degrees Celsius for a second typical susceptor structure.

FIG. 3 shows a graph of impedance (real, $R_s$, and imaginary, $X_s$) plotted against temperature in degrees C for a susceptor structure having a substrate made of amorphous, nonoriented polycyclohexylene-dimethylene terephthalate (PCDMT). FIG. 3 shows that, upon exposure to microwave energy, breakup did not occur in the susceptor structure even as the susceptor structure approached approximately 295C. Thus, the susceptor structure would reach temperatures that could scorch or char paper or burn food products in contact with the susceptor structure.

It has been observed that, for a susceptor structure to achieve a higher cooking temperature than that achieved by a conventional PET susceptor, but a cooking temperature lower than the temperature required to scorch paper, it should have a substrate with an onset of melting, by scanning calorimetry using a 10–20 mg sample and at a temperature rise rate of 10° K./min, between approximately 260° C. and 300° C. with a preferable target range of about 270–280° C. Further, the substrate in a preferred susceptor structure should have properties sufficient to cause a deformation in physical size as the susceptor structure heats. The forces causing the size deformation should be exerted in the substrate of the susceptor structure as the substrate approaches the onset of the melting temperature. The substrate is coupled to the metalized layer so that melting and physical size deformation of the substrate cause discontinuity in the metalized layer.

The net result is a susceptor structure that has a thermocouple-measured breakup temperature of approximately 230–245° C. This operating temperature is sufficient to enhance the crisping ability of the susceptor structure while not allowing the susceptor structure to heat to a point at which it could scorch paper.

In one preferred embodiment of the susceptor structure of the present invention, substrate 12 is formed of a copolyester, PCDMT, that is commercially available under the trademark Kodar Thermx PM13319 sold by Eastman Chemical Products, Inc. subsequently oriented and heatset.

Substrate 12 was initially a 4 inch square sheet of amorphous PCDMT material with a thickness of 0.004 inches. The sheet was then heated and oriented by stretching on a T.M. Long stretcher. The sheet was stretched into a 7.25 inch square film having a thickness of approximately 0.001 inches. The actual linear stretch was approximately 1.81 (i.e., 7.25/4=1.81). The film was then heatset at a temperature of approximately 465° F.

The heatset, oriented PCDMT substrate was then metalized. Approximately 255Å of Chromium was deposited on the substrate using vacuum evaporation, vapor deposition or another suitable method, resulting in a metalized layer ideally having a surface resistance of approximately 100Ω/sq.

Support layer 16 was formed of a commercially available susceptor grade paperboard. Adhesive layer 18 was an aqueous laminating adhesive suitable for microwave use, specifically adhesive WC-3458-Y-EN from H.B. Fuller Co. of Vadnais Heights, Minn. 55110.

Figure 4:
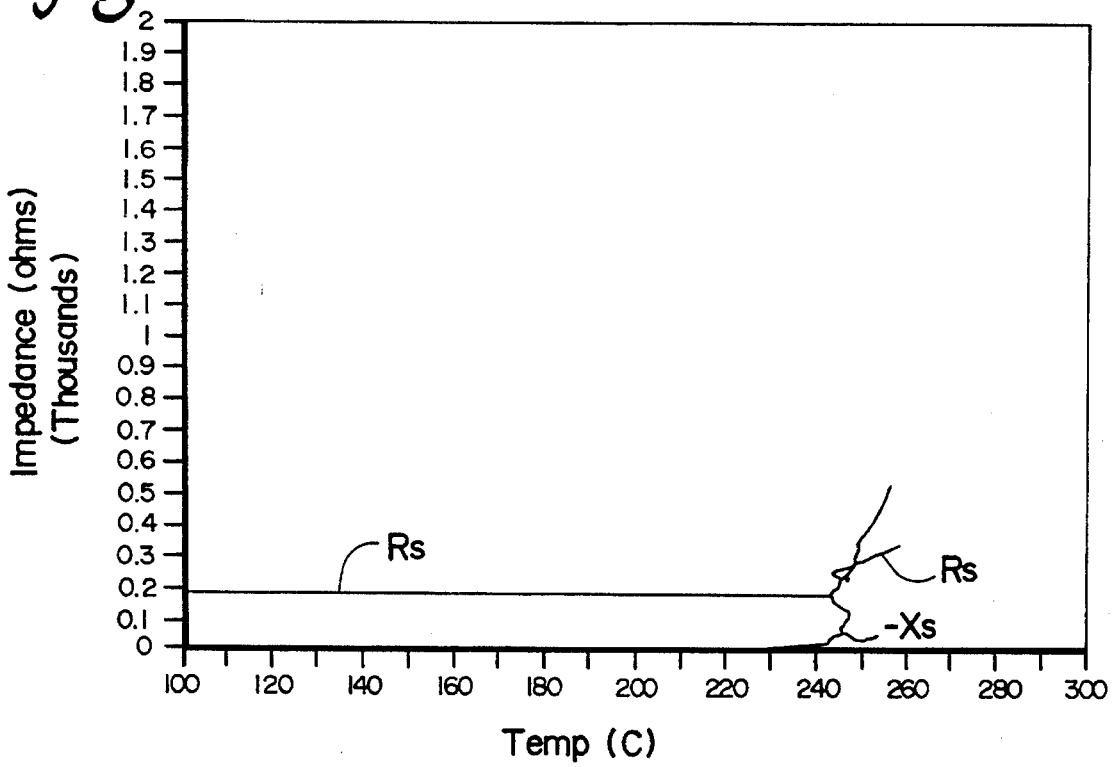
FIG. 4 shows a plot of impedance (real and imaginary) plotted against temperature and degrees Celsius for a susceptor structure of the present invention.

FIG. 4 is a graph of the impedance (real, $R_s$, and imaginary, $X_s$) of the susceptor of the present invention plotted against temperature in degrees C. FIG. 4 shows that breakup in the susceptor of the present invention did not begin until between approximately 240° C. and 250° C. Hence, the susceptor structure of the present invention heated to a significantly higher temperature than a conventional PET susceptor structure, yet not as high as an amorphous PCDMT susceptor structure. Thus, the susceptor structure of the present invention is suitable for providing good crisping and browning of foods while not reaching temperatures sufficient to char paper.

This preferred embodiment has been described with reference to a chromium metalized layer 14 and an oriented and heatset PCDMT substrate 12. However, other materials could be used. For example, metalized layer 14 could be an aluminum layer deposited on substrate 12. Also, substrate 12 could be any other suitable material. For example, in cooking of foods, substrate 12 could be formed of any material conditioned such that it would be characterized by an onset of melting in the range of approximately 260–300° C., and in which physical size deformation (e.g., shrinking) forces are exerted in the material as the substrate approaches the onset of the melting point. The point at which physical size deformation forces are exerted can be set using a variety of methods such as orientation. Semi-crystalline materials are generally suitable, including polyethylene naphthalate (PEN).

Although the present invention has been described with reference to preferred embodiments, workers skilled in the art will recognize that changes may be made in form and detail without departing from the spirit and scope of the invention.

What is claimed is:

1. A method of making a susceptor structure, the method comprising the steps of:

conditioning a substrate by mechanically inducing stresses in the substrate tending to cause physical size deformation upon exposure to a desired amount of heat energy, the conditioned substrate having an onset of melting in a range of approximately 260°–300°, and the physical size deformation of the substrate occurring as the substrate approaches the onset of melting;

coupling the substrate to a metalized layer so that melting and the physical size deformation of the substrate cause discontinuities to develop in the metalized layer; and providing supporting means for supporting the metalized layer and the substrate.

2. The method of claim 1 wherein the step of conditioning comprises:

heatsetting the substrate to a desired temperature.

3. The method of claim 1 wherein the step of conditioning comprises:

orienting the substrate.

4. The method of claim 3 wherein the step of orienting comprises:

stretching the substrate.

5. The method of claim 1 wherein the substrate comprises:

polyethylene naphthalate.

6. The method of claim 1 wherein the substrate comprises:

polycyclohexylenedimethylene terephthalate.

* * * * *

UNITED STATES PATENT AND TRADEMARK OFFICE

CERTIFICATE OF CORRECTION

PATENT NO. : 5,527,413
DATED : June 18, 1996
INVENTOR(S) : Michael R. Perry, et al.

It is certified that error appears in the above-indentified patent and that said Letters Patent is hereby corrected as shown below:

On the title page:

Under [56] References Cited:

Under U.S. PATENT DOCUMENTS, please delete "4,641,004 2/1987 Seiferth".

Under FOREIGN PATENT DOCUMENTS, please correct "0334389" to read --0344839--.

Under OTHER PUBLICATIONS, please delete the second occurrence of the following publications:

"*Microwave Packaging Symposium*", Sponsored by Rutgers University Center for Packaging Science & Engineer, and American Management Association, Apr. 23-24 1990.
"Plastics which Extend the Performance of Microwave Packaging," F.E. McFarlane et al, Eastman Chemical Company, Kingsport, Tennessee, Apr. 1990/.
"Application of a Teflon Single-Sided Migration Cell for Measuring Migration Through Microwave Susceptor Films," A group of overhead slides from a program by T.H. Begley and H.C. Hollifield.

UNITED STATES PATENT AND TRADEMARK OFFICE

CERTIFICATE OF CORRECTION

PATENT NO. : 5,527,413

DATED : June 18, 1996

INVENTOR(S) : Michael R. Perry, et al.

It is certified that error appears in the above-indentified patent and that said Letters Patent is hereby corrected as shown below:

"Application of a Teflon Single-Sided Migration Cell for Measuring Migration Through Microwave Susceptor Films," A group of overhead slides from a program by T.H. Begley and H.C. Hollifield.

Signed and Sealed this

Fifth Day of November, 1996

Bruce Lehman

*Attest:*

BRUCE LEHMAN

*Attesting Officer*

*Commissioner of Patents and Trademarks*